US005638571A

United States Patent [19]

Echeverria

[11] Patent Number: 5,638,571

[45] Date of Patent: Jun. 17, 1997

[54] BULK CARGO BAG CLEANING APPARATUS AND METHOD

[75] Inventor: Carlos M. Echeverria, Opa Locka, Fla.

[73] Assignee: Marino-Technologies, Inc., Opa Locka, Fla.

[21] Appl. No.: 589,558

[22] Filed: Jan. 22, 1996

[51] Int. Cl.[6] ..... B08B 5/00

[52] U.S. Cl. ..... 15/304; 134/16; 134/21; 134/22.1; 134/22.18; 141/89; 141/93; 141/316

[58] Field of Search ..... 141/85, 89, 91–93, 141/114, 313–317, 1, 10; 55/294, 431; 15/304, 345; 134/16, 21, 22.1, 22, 18

[56] References Cited

U.S. PATENT DOCUMENTS

| | | | |
|---|---|---|---|
| 2,643,804 | 6/1953 | Scranton . | |
| 2,671,585 | 3/1954 | Kindseth . | |
| 4,591,075 | 5/1986 | Eriksson | 222/195 |
| 5,036,893 | 8/1991 | DeCrane | 141/114 |
| 5,286,302 | 2/1994 | Wickham, III | 134/22.1 |
| 5,478,406 | 12/1995 | Derby et al. | 134/16 |
| 5,535,791 | 7/1996 | Lisec | 141/316 X |
| 5,558,137 | 9/1996 | Futerman | 141/313 X |

FOREIGN PATENT DOCUMENTS

| | | | |
|---|---|---|---|
| 3613394 | 10/1987 | Germany | 141/93 |

OTHER PUBLICATIONS

Bulk Bag Express Leaflet – 1995 Memphis TN 38105.

*Primary Examiner*—J. Casimer Jacyna
*Attorney, Agent, or Firm*—Alvin S. Blum

[57] ABSTRACT

An apparatus and method for cleaning used bulk or cargo bags enables a worker to vacuum clean the entire outside of the bag without climbing up and down. An air supply/fill clamp assembly attaches to the fill opening. It inflates and supports the bag. An air exhaust discharge clamp attaches to the discharge opening to carry away interior residue. A power elevation mechanism raises and lowers the air supply/fill clamp assembly under operator control to thereby position the bag at whatever level is most useful to the operator as the outside is being vacuum cleaned with a vacuum cleaner.

11 Claims, 1 Drawing Sheet

BULK CARGO BAG CLEANING APPARATUS AND METHOD

BACKGROUND OF THE INVENTION

This invention relates to cargo or bulk bags and more particularly to apparatus and methods for cleaning the dry materials residue from used cargo bags before their reuse.

Cargo bags of flexible material are well known for transport and storage of dry bulk materials. They are provided with an upper tubular fill opening and a lower tubular discharge opening and lifting loops to permit the bag to be supported while filling, transporting and dispensing the contents. The bags are made of sturdy materials to support the weight of the filled bag. They may be reused many times. Before refilling the bags, after use, they are generally cleaned of the residual bulk materials clinging to the external surfaces of the bag, since the bag must be shipped in interstate commerce. The soiled empty bags are collapsed into a small volume easily enclosed in a protective outer bag. In this form they are transportable to a cleaning station or the filling station, but the inner and outer surfaces are preferably cleaned before the bags are refilled to protect the public and workers.

In the usual cleaning practice, the empty bag is installed on a framework with an overhead air pressure supply attached to the input to inflate the bag. A worker then vacuums the top, sides and bottom of the inflated bag. In order to access the bottom of the bag after clamping the discharge tube to an air exhaust, the fill tube must be quite high above the floor. An elevated ramp or balcony must be provided to enable the worker to reach the upper portions of the suspended bag. It is quite labor intensive to climb up and down while attaching, vacuuming, and detaching the top of the bag. The whole point of cleaning and reusing a bag rather than disposing after a single use is cost savings. When the labor and space costs get too high, the cleaning option becomes less attractive.

SUMMARY OF THE INVENTION

It is accordingly an object of the invention to provide an apparatus and method for the cleaning of used bulk bags that will be faster, safer, less labor intensive, and more economical of plant space than that of the prior art to encourage the reuse of the bags, and discourage their disposal after use.

The apparatus of the invention comprises a framework supporting an exhaust tube at the bottom with clamping features for sealingly engaging the discharge tube of the bag at a convenient height and an air supply tube at the top with clamping features for sealingly engaging the intake tabulation of the bag. The elevation of the air supply clamping assembly is continuously adjustable under the control of the operator. After the discharge tube is clamped onto the exhaust tube, the air supply clamping assembly is lowered to a convenient height. The bag intake tube is clamped onto the air supply tube and the bag inflated. The bag top is then vacuumed. After the top is clean, the bag is raised further so that the sides are easily cleaned. The bag may be further raised while the bottom is cleaned. Then the discharge tube is released, the top lowered and unclamped and ready for the next bag. This greatly speeds up the process, reduces the worker exposure to risk associated with going up and down an elevated workplace and takes up much less plant space.

These and other features, objects and advantages of the invention will become more apparent when the detailed description is studied in conjunction with the drawings, wherein like reference numerals refer to similar parts throughout the drawings.

DETAILED DESCRIPTION OF PREFERRED EMBODIMENTS

Figure 4:
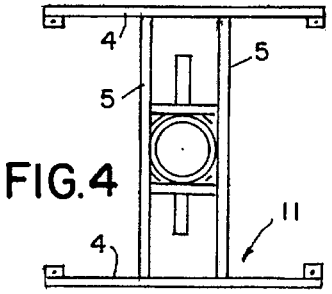
FIG. 4 is a top view of the movable upper bag holding frame.
Figure 1:
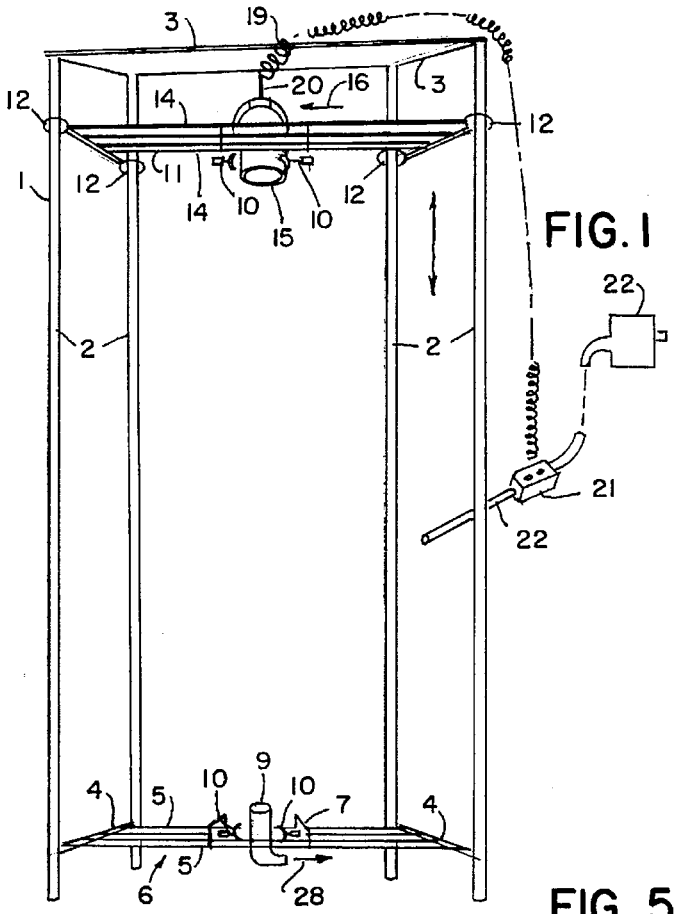
FIG. 1 is a perspective view of the cleaning apparatus of the invention.

Referring now first to FIGS. 1–4, the apparatus of the invention comprises a support means 1 having four vertical posts 2 joined together at the top by horizontal bars 3. A rigid bottom transverse assembly 6 includes horizontal bars 4, 5 joining the posts together about 50 cm. above the bottom of the posts. A discharge clamp means 7, mounted on transverse assembly 6, is provided for sealingly connecting to the tubular discharge opening 30 of a bulk bag 8. This clamp assembly includes a tube 9 for insertion into the bag opening, and a pair of half circle jaws 10 which clamp over the tubular discharge 30 of the bag, clamping it against the tube 9. Tube 9 is connected to an air exhaust (not shown) at 28. The cleaning process begins by clamping the discharge tube 30 onto the exhaust tube 9.

A fill clamp assembly 11 is slidingly mounted on the vertical posts 2 by the four circular collars 12 on the ends of bars 13 which support cross members 14. A tubular elbow 15 is mounted on the cross members 14. A supply of compressed air is provided at intake 16 to the elbow for inflating the bag. The tubular fill opening 29 of a bulk bag is slipped over the elbow and clamped in place by the two semicircular jaws 10 which press the fabric tube 29 of the bag tightly enough against the rigid elbow to seal and completely support the bag. The jaws 10 are moved by power drives well known in the art, as exemplified by the pneumatic cylinders 17. The bag fill opening is clamped in place while the fill clamp assembly is positioned at a safe and convenient height for the operator. After being clamped, compressed air fills the bag. Air is exhausted from the bag at exhaust means 28 which may include solid residues blown from the inflated bag. The exhaust means includes means well known in the art for separating out these solids.

Raising and lowering the fill clamp means 11 enables the operator to position the inflated bag at various elevations as required while vacuum cleaning the top sides and bottom outer surfaces of the used bulk bag while standing at one level, generally the shop floor. This eliminates the prior art need for an elevated balcony and stairs to properly clean large bags. The fill clamp frame 11 is raised and lowered by a cable 20 wound on power winch 19 under operator control using control box 21 which may optionally be attached to the wand 22 of the vacuum cleaner 23.

When the operator is standing on the floor vacuuming the outer surfaces of the inflated bag, merely operating the control box 21 will present new surfaces to be cleaned without stooping or climbing onto an elevated platform as in the prior art. The operator does have to walk all around the bag, and the cleaning apparatus must be positioned far enough away from adjacent walls to permit operator access.

Figure 5:
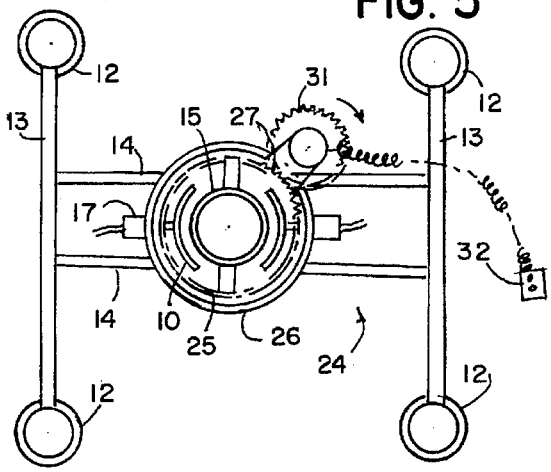
FIG. 5 is a top view of the movable upper bag holding frame of another embodiment of the invention having a swivel.
Figure 3:
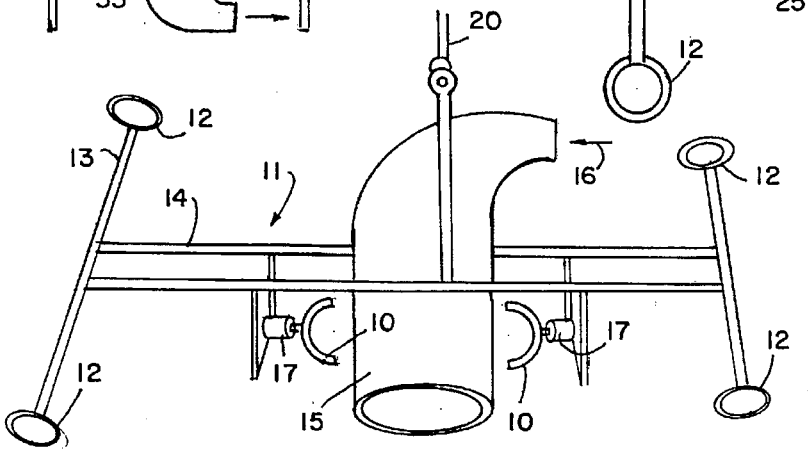
FIG. 3 is a perspective view of the air connection and clamp arrangement for the fill tube of the bag.

As shown in the embodiment of FIG. 5, the clamp assemblies may both be arranged on swivels so that the operator does not need to walk behind the apparatus to clean the back of the bag. Instead, the bag may be rotated about its vertical axis by 180° so that the back of the bag is accessed. Only the upper fill clamp assembly 24 is shown, the lower discharge clamp assembly would be similarly equipped. The swivel mechanism or assembly, hereinafter referred to as swivel may include an inner ring 25 to which the elbow 15 and clamps 10 and clamp drives 17 are attached. This is held in place by, and free to rotate within, outer ring 26. The inner ring 25 may be provided with gear teeth 27 engaged by motor driven pinion gear 31 operated by swivel control 32. The rotation about a vertical axis need not exceed 180° to satisfy the requirements of the cleaning operation.

Figure 2:
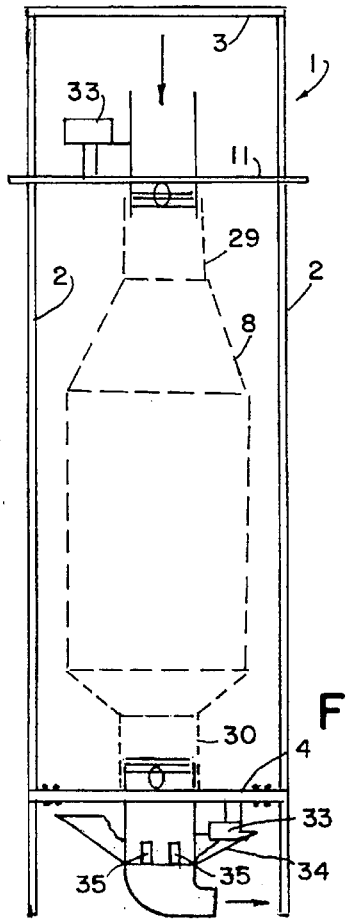
FIG. 2 is a side elevation view of the support frame of the apparatus with bulk bag in place (bag shown in phantom).

The apparatus may optionally be provided with vibrators 33 shown in FIG. 2, that shake the exhaust tube 9 and air intake 15 to thereby cause the suspended bag to shake and loosen clinging material.

The apparatus may optionally be provided with a conical catch tray 34, shown in FIG. 2, at the bottom of the support frame 1. This will catch any debris that falls from the bag. The tray may be provided with closable valve elements 35 to the exhaust so that any debris caught in the tray will be aspirated into the exhaust.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A bulk bag cleaning apparatus for a bulk bag, the bag having a top with a tubular fill opening, and a bottom with a tubular discharge opening, the apparatus comprising:

(A) a support means for supporting a bag;

(B) air exhaust means for removing compressed air;

(C) discharge clamp means attached to said support means for sealingly connecting, in fluid communication, said discharge opening to said exhaust means;

(D) air supply means for supplying compressed air as required;

(E) fill clamp means slidably attached to said support means for sealingly connecting, in fluid communication, said fill opening to said air supply means, and for supporting said bag;

(F) power operated elevation means operatively interconnecting said fill clamp means and said support means, said elevation means adapted for adjusting the elevation of said fill clamp means above said discharge clamp means under operator control; and (G) cleaning apparatus for cleaning said bag on the outer surface thereof.

2. The apparatus according to claim 1, in which the cleaning apparatus includes a vacuum wand and said wand incorporates controls for operating said elevation means.

3. The apparatus according to claim 2, in which said discharge clamp means and said fill clamp means are both provided with swivels so that a bag suspended therebetween may be rotated about a vertical axis for ease of access to an operator.

4. The apparatus according to claim 3, in which said swivels are power actuated under operator control.

5. The apparatus according to claim 1, in which said discharge clamp means and said fill clamp means are both provided with swivels so that said bag suspended therebetween may be rotated about a vertical axis for ease of access to an operator.

6. The apparatus according to claim 5, in which said swivels are power actuated under operator control.

7. The apparatus according to claim 1, further comprising at least one vibrator connected to at least one of said air exhaust means and said air supply means.

8. The apparatus according to claim 1, further comprising a conical tray disposed below said air exhaust means for catching falling material, said tray provided with closable communications to said air exhaust means.

9. A method of cleaning a bulk bag, the bag having a top with a tubular fill opening and a bottom with a tubular discharge opening, the method comprising the steps of:

(A) clamping the discharge opening to an air exhaust by an exhaust clamp;

(B) clamping an air supply to the tubular fill opening with an input clamp;

(C) lifting the bag by lifting the input clamp;

(D) inflating the bag with the air supply through the fill opening;

(E) exhausting the air through the discharge opening by the air exhaust; and (F) cleaning the bag on the outside thereof by a cleaning apparatus while elevating and lowering the input clamp for accessing various levels of the inflated bag.

10. The method of claim 9, further comprising the step of vibrating the bag with at least one vibrator.

11. The method of claim 9, further comprising the steps of collecting falling debris falling from the bag in a conical tray and aspirating the debris with the air exhaust.

* * * * *